US006439868B1

(12) United States Patent
Tomoiu

(10) Patent No.: US 6,439,868 B1
(45) Date of Patent: Aug. 27, 2002

(54) ROTARY ENGINE

(76) Inventor: Constantin Tomoiu, 11 Old South Ave., Stratford, CT (US) 06497

( * ) Notice: Subject to any disclaimer, the term of this patent is extended or adjusted under 35 U.S.C. 154(b) by 0 days.

(21) Appl. No.: 09/737,890

(22) Filed: Dec. 15, 2000

(51) Int. Cl.[7] ..... F03C 2/00

(52) U.S. Cl. ..... 418/143; 418/221; 418/259; 418/266

(58) Field of Search ..... 418/266, 221, 418/143, 259

(56) References Cited

U.S. PATENT DOCUMENTS

| | | | | | |
|---|---|---|---|---|---|
| 3,626,265 | A | * | 12/1971 | Emmasingel | 418/266 |
| 3,627,456 | A | * | 12/1971 | Gerlach | 418/268 |
| 3,672,797 | A | * | 6/1972 | Gerlach et al. | 418/221 |
| 4,014,298 | A | | 3/1977 | Schulz | |
| 4,448,161 | A | | 5/1984 | Tseng | |
| 4,507,067 | A | * | 3/1985 | Hansen | 418/221 |
| 4,620,514 | A | | 11/1986 | Tseng | |
| 4,860,704 | A | | 8/1989 | Slaughter | |
| 5,247,916 | A | | 9/1993 | Riney | |
| 6,071,106 | A | * | 6/2000 | Martensen et al. | 418/259 |

FOREIGN PATENT DOCUMENTS

| | | | | |
|---|---|---|---|---|
| DE | 4221199 | * | 2/1993 | 418/143 |
| FR | 2591286 | * | 6/1987 | 418/221 |

* cited by examiner

*Primary Examiner*—Thomas Denion
*Assistant Examiner*—Theresa Trieu
(74) *Attorney, Agent, or Firm*—Fattibene & Fattibene; Paul A. Fattibene; Arthur T. Fattibene

(57) ABSTRACT

A rotary engine having end plates attached to a rotor and moving therewith. A rotor has a plurality of blades reciprocally mounted therein and placed within a housing. A chamber is formed between the blades, the rotor, the end plates, and a cylindrical stator. The end plates move with the rotor, thereby improving sealing. The structure permits easy assembly and manufacture and substantially reduces sealing problems associated with rotary engines. The rotary engine may be applied to many applications where rotational motion is needed.

14 Claims, 3 Drawing Sheets

ROTARY ENGINE

FIELD OF THE INVENTION

The present invention relates in general to a rotary engine having a plurality of chambers, and more particularly to a rotary engine with improved sealing.

BACKGROUND OF THE INVENTION

There are many different types of rotary engines. Most rotary engines, however, have difficulty sealing, and therefore have a reduced efficiency. Many rotary engines have the rotor placed within a housing. The chamber is generally formed with a stationary end wall adjacent a rotor. One such rotary engine is disclosed in U.S. Pat. No. 4,014,298 entitled "Concentric Rotary Engine" issuing to Schulz on Mar. 29, 1977. Therein disclosed is a concentric rotary engine concentrically disposed within a hollow rotor housing. The rotor is in slidable, sealable and rotatable engagement with the inner surface of the rotor housing. Another rotary engine is disclosed in U.S. Pat. No. 4,860,704 entitled "Hinge Valve Rotary Engine With Separate Compression And Expansion Sections" issuing to Slaughter on Aug. 29, 1989. Therein disclosed is a rotary engine with respective smooth surfaced compression and expansion rotors mounted within chambers. The expansion rotor has opposite end faces, which, in cooperation with end face seals, seal against the partitions.

While these and other rotary engines have proven satisfactory for their intended use, there is a need for an improved rotary engine that provides better sealing and more efficient operation.

SUMMARY OF THE INVENTION

The present invention comprises a rotary engine that has a substantial portion of a chamber that rotates with the rotor of the rotary engine. A rotor has movable blades contained therein that extend radially inward and outward. The rotor has fixed end walls or plates that rotate with the rotor. The rotor assembly is contained within a cylindrical housing that has a plurality of chamber dividers acting as cam surfaces for moving the movable blades. The chamber dividers have a sealing surface adjacent the rotor. The end plates rotate with the rotor providing improved sealing between the end plate and the chambers of the rotary engine.

Accordingly, it is an object of the present invention to provide a rotary engine having improved efficiency.

It is a further object of the present invention to provide a rotary engine that has improved sealing, especially between the rotor assembly and an end plate.

It is an advantage of the present invention that it is relatively easy to manufacture and assemble.

It is a further advantage of the present invention that it can maintain a high pressure with little seal leakage during extended use and operation.

It is a feature of the present invention that end plates are attached to the rotor and move with the rotor.

It is a further feature of the present invention that centrifugal force helps to seal the chamber between the movable blade and the housing.

These and other objects, advantages, and features will become readily apparent in view of the following more detailed description.

DETAILED DESCRIPTION OF THE PREFERRED EMBODIMENTS

Figure 1:
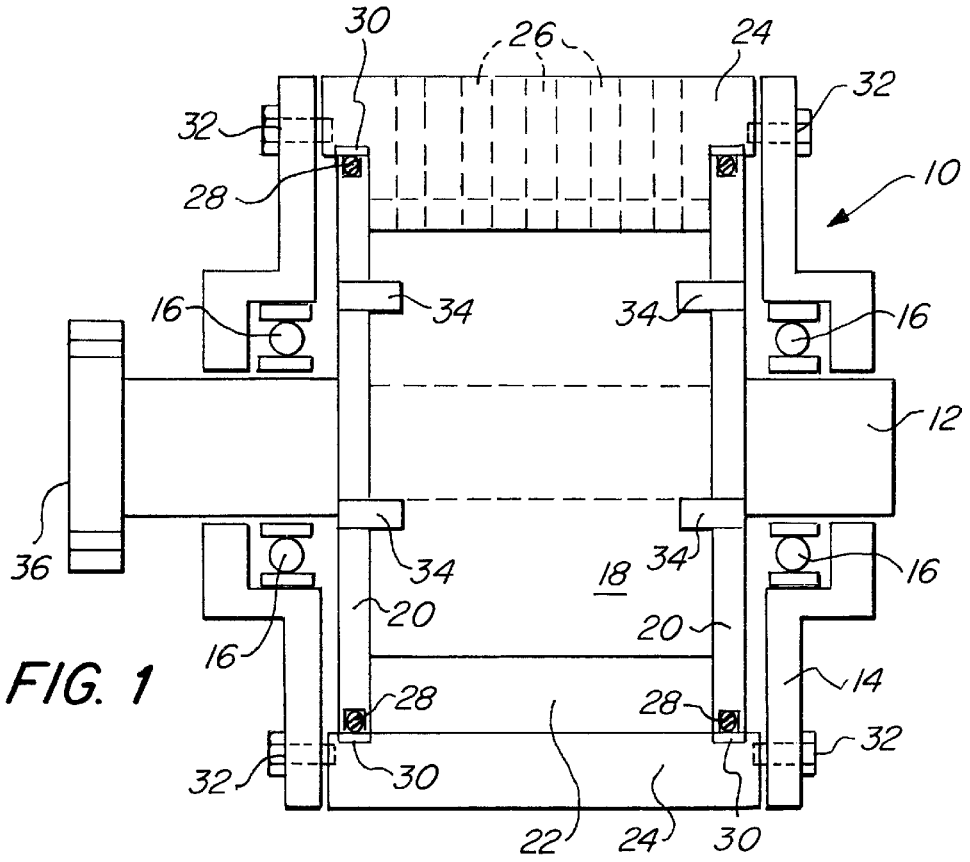
FIG. 1 schematically illustrates a front elevational view of the present invention.

FIG. 1 schematically illustrates the rotary engine 10 of the present invention. The rotary engine 10 has a central shaft 12 with a rotor assembly enclosed in a housing 14. Bearings 16 are placed between the shaft 12 and the housing 14. Rotor 18, which is placed within the housing 14, is connected to the shaft 12. Rotor 18 has a pair of end plates 20 attached thereto by rotor bolts 34. A plurality of movable blades 22 extend between the rotor 18 and a stator 24. The blades 22 are mounted within rotor 18 so as to move radially in and out. Formed within stator 24 are a plurality of exhaust ports 26. At the point of contact between the end plates 20 and the stator 24 O-ring seals 28 are placed. Additionally, a sliding surface 30 may be inserted between the stator 24 and the end plates 20 contacting the O-rings 28. The sliding surface 30 may be made of a friction free material, such as Teflon brand polymer. Bolts 32 connect the stator 24 to the housing 14. A coupling 36 is attached to one end of shaft 24. The coupling 36 may then be coupled to other rotary engines or a load. The end plates 20, which are fixed to the rotor 18 and form a part of the rotor assembly, will rotate together with the rotor 18. Accordingly, the seal between the blade 22 and the end plate 20 may be made relatively leak free and is less prone to wear, increasing the efficiency and longevity of the rotary engine 10.

Figure 2:
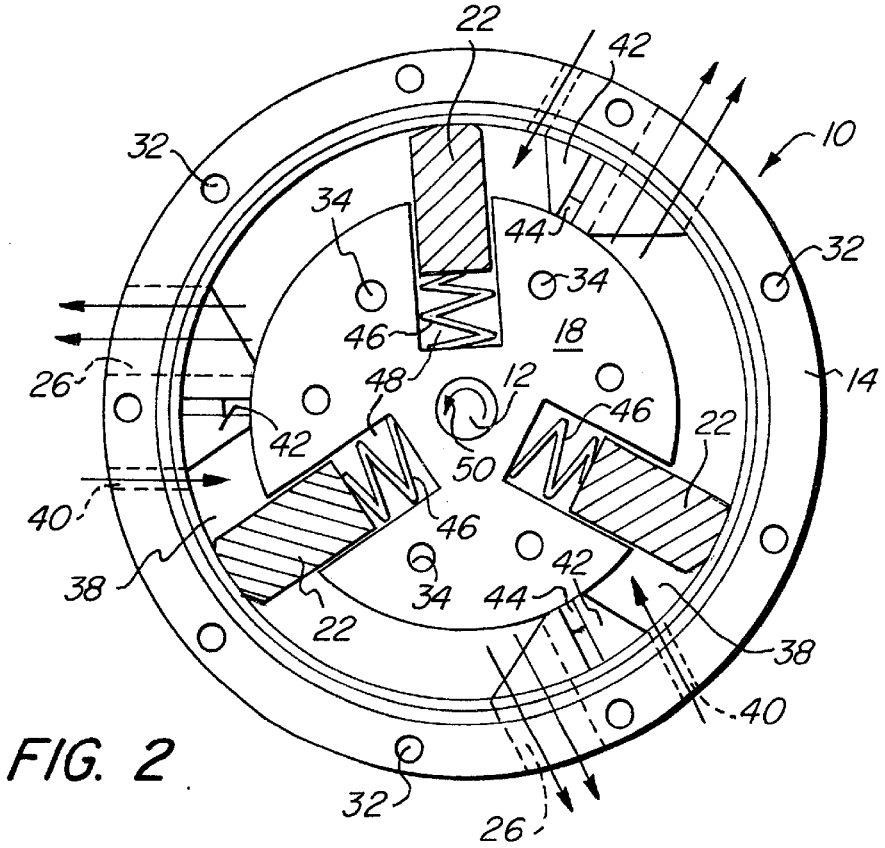
FIG. 2 schematically illustrates a side elevational view of the present invention.

FIG. 2 schematically illustrates the interior of the rotary engine 10. Chambers 38 are formed between blades 22 and the chamber dividers 42. Chamber dividers 42 have a seal 44 adjacent the surface of rotor 18. Blades 22 form a seal against the cylindrical surface of stator 24 attached to housing 14. Springs 46 force the blade 22 radially outward and are advantageous when the rotor 18 is turning at relatively low speed or revolutions. At higher revolutions, the centrifugal force will exert additional pressure radially outward, creating a better seal. The blades 28 reciprocate within blade channels 48. An inlet valve 40 provides pressurized gas into chamber 38, causing the rotor 18 to move in the direction of arrow 50. Accordingly, the exhaust gases are outlet through exhaust ports 26 as the rotor 18 rotates. A suitable valve or timing system may be utilized to time the injection of pressurized gas into the chamber 38 so as to prevent the pressurized gas entering through inlet port 40 from escaping when the chamber 38 also communicates or is open to the exhaust ports 26.

Figure 3:
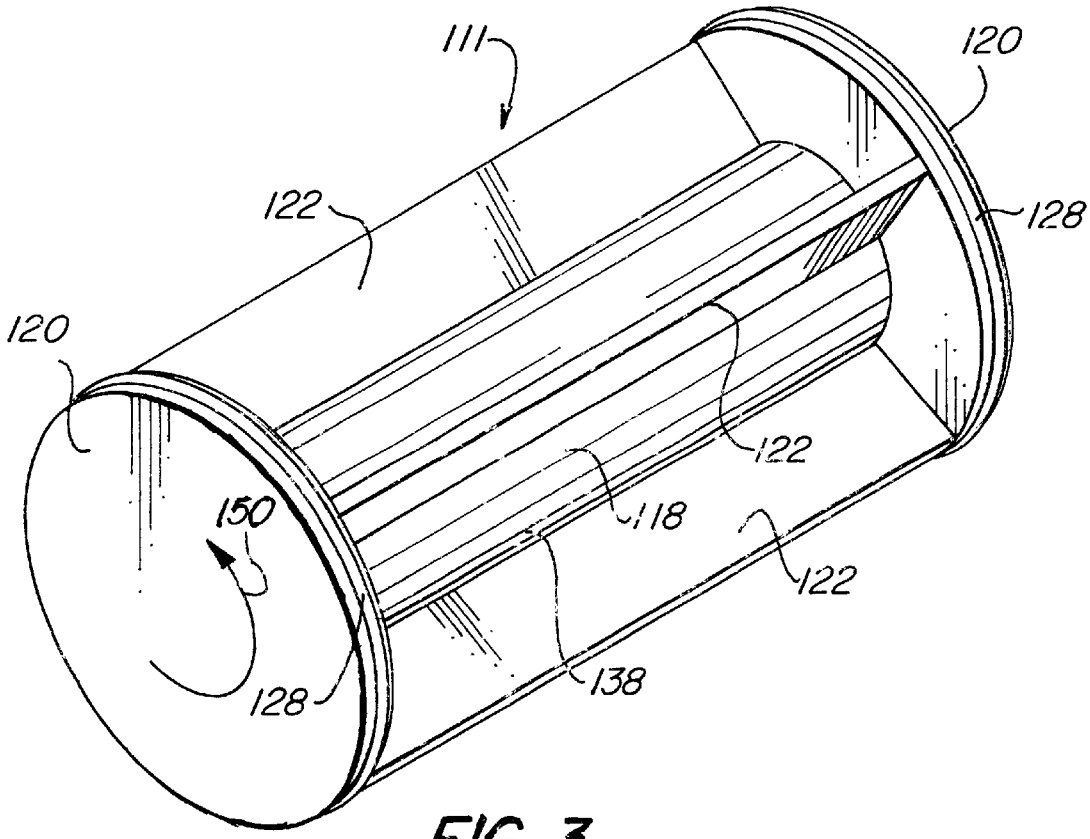
FIG. 3 is a perspective view illustrating the rotor assembly of another embodiment.

FIG. 3 more clearly illustrates another embodiment of a rotor assembly 111. The rotor assembly 111 comprises a rotor 118 having end plates 120 attached to the ends of rotor 118. Seals 128 extend around the peripheral edge of the end plates 120. A plurality of blades 122 are radially movably mounted on the rotor 118 and the end plates 120. There may be any number of blades 122. The blades 122 and the end plates 120 form a chamber 138. The top surface of chamber 138 is bounded by the surface of a stator, not illustrated. Accordingly, the chamber 138, defined by the blades 122 and the end plates 120, moves with the rotor 118. Rotor 118 may move in the direction of arrow 150. Since the chamber 138 moves with the rotor 118, the seal between the blades 122 and the fixed end plates 120 may be made substantially less prone to leakage or wear. This improves the sealing efficiency and longevity of a rotary engine.

Figure 4:
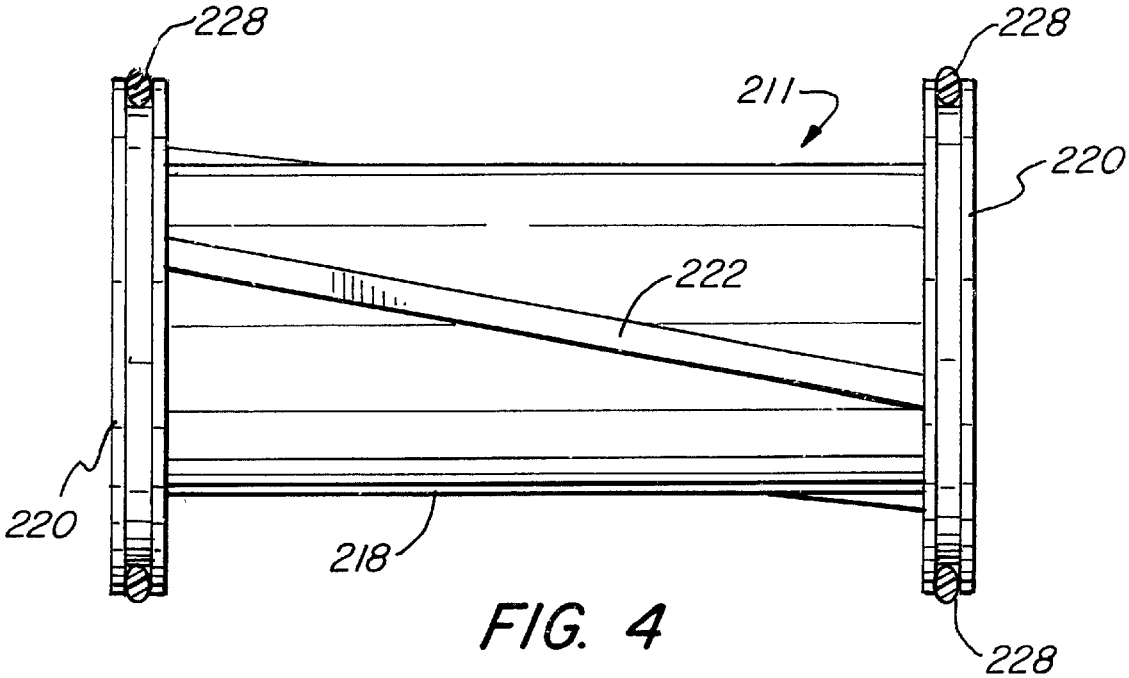
FIG. 4 schematically illustrates a front elevational view of another embodiment.

FIG. 4 schematically illustrates another embodiment of a rotor assembly 211 of the present invention. In this embodiment, blade 222 is positioned diagonally or transverse to the longitudinal axis of rotor 218. Affixed to rotor 218 are two end plates 220. The end plates 220 have a seal 228 therein.

Figure 5:
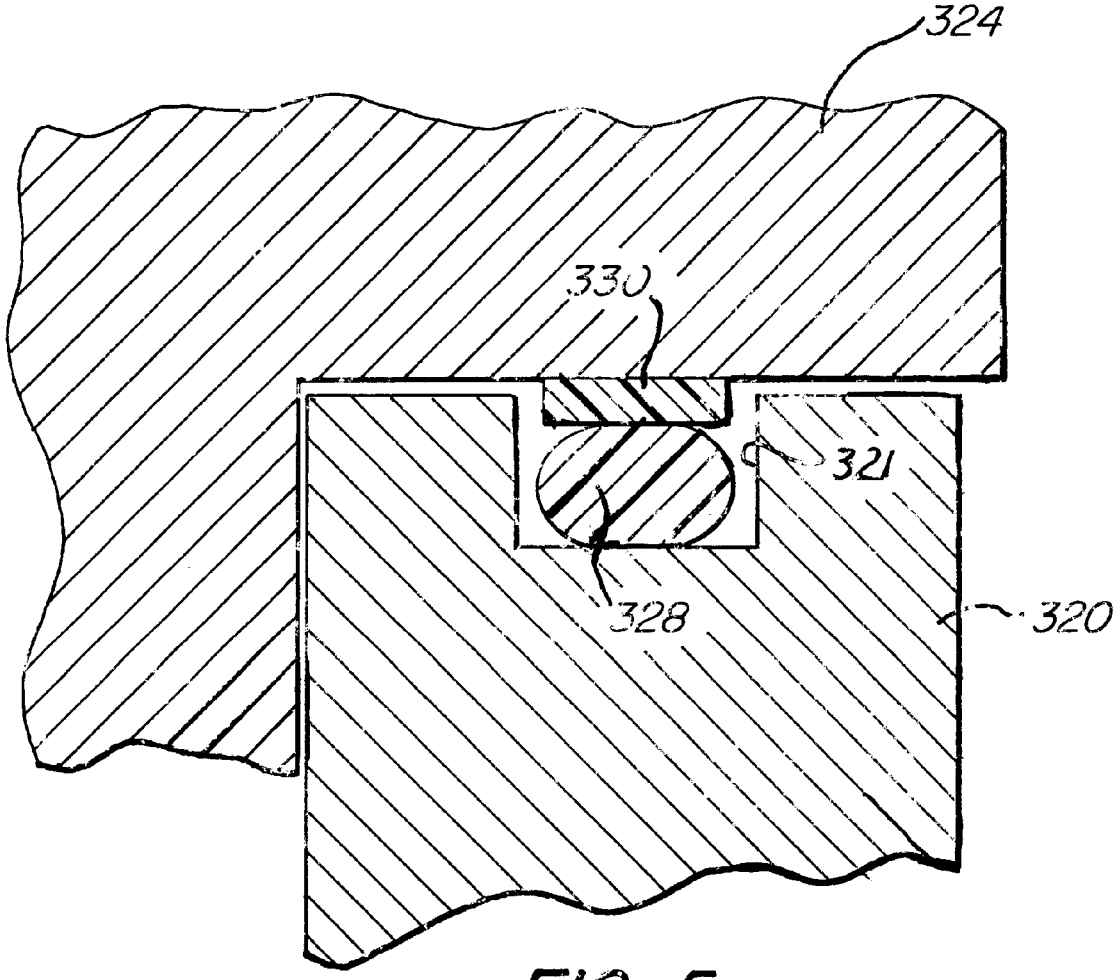
FIG. 5 is a partial sectional view of a preferred sealing structure.

FIG. 5 schematically illustrates an embodiment of preferred sealing. End plate 320 has a groove or channel 321 therein. Placed within channel 321 is O-ring 328. The O-ring 328 may be made of a soft elastic or plastic material, such as silicone. Adjacent the O-ring 328 is a sliding surface 330. Sliding surface 330 may be made of a tough polymer, such as tetrafluoroethylene sold under the trademark Teflon. The sliding surface 330 contacts stator 324. This sealing structure is very effective in sealing between the end plate 320 attached to the rotor and the stator 324. The sliding surface 330 and O-ring 328 are retained within channel 321. Additionally, the sliding surface 330 provides a smooth surface for the O-ring 328. The O-ring 328 will remain stationary. This reduces friction and provides good long lasting sealing.

Accordingly, the present invention provides an improved rotary engine that has increased efficiencies and longevity. A portion of the sealing difficulties in rotary engines is eliminated because a substantial portion of the surfaces forming the chamber of the rotary engine move with the rotor. This eliminates much of the wearing and leaking of seals used in a rotary engine. Therefore, the rotary engine of the present invention operates smoothly and efficiently. Additionally, the structure of the rotary engine of the present invention is relatively easily manufactured and assembled. The present invention may be used in any application where a rotary power source is required.

While the present invention has been described with respect to several embodiments, the usefulness of the present invention may be applied to different arts. Additionally, although the preferred embodiment has been illustrated and described, it will be obvious to those skilled in the art that various modifications may be made without departing from the spirit and scope of this invention.

What is claimed is:

1. A rotary engine comprising:

a housing;

a cylindrical rotor placed within said housing;

a pair of end plates attached to said cylindrical rotor;

a plurality of movable blades held by said cylindrical rotor and moving therewith;

a cylindrical stator attached to said housing and containing said cylindrical rotor and plurality of blades;

a channel formed in each of said pair of end plates;

an O-ring placed in each of said channels; and a sliding surface placed adjacent each of said O-rings, whereby said pair of end plates move with said rotor and a seal is formed between each of said pair of end plates and said cylindrical stator.

2. A rotary engine as in claim 1 further comprising:

a plurality of chamber dividers attached to said cylindrical stator and contacting said cylindrical rotor.

3. A rotary engine as in claim 1 further comprising:

an exhaust port on one side of each of said plurality of chamber dividers; and an inlet port on another side of each of said plurality of chamber dividers.

4. A rotary engine as in claim 1 wherein:

said sliding surface comprises tetrafluoroethylene.

5. A rotary engine as in claim 1 wherein:

said cylindrical rotor has an axis of rotation, and each of said plurality of movable blades has a longitudinal axis parallel to the axis of rotation of said cylindrical rotor.

6. A rotary engine comprising:

a housing;

a cylindrical rotor placed within said housing;

a pair of end plates attached to said cylindrical rotor;

a plurality of movable blades held by said cylindrical rotor and moving therewith;

a cylindrical stator attached to said housing and containing said cylindrical rotor and plurality of blades, whereby said pair of end plates move with said rotor, and wherein said cylindrical stator has an axis of rotation, and each of said plurality of movable blades has a longitudinal axis transverse to the axis of rotation of said cylindrical stator.

7. A rotary engine comprising:

a housing;

a shaft extending though said housing;

a cylindrical rotor placed within said housing and rotating with said shaft;

a pair of end plates attached to said cylindrical rotor, said shaft extending though said end plates;

a plurality of blades held by said cylindrical rotor, each of said plurality of blades adapted to move radially within said cylindrical rotor;

a cylindrical stator attached to said housing and containing said cylindrical rotor and plurality of blades; and a plurality of stationary chamber dividers extending radially from said cylindrical stator and contacting said cylindrical rotor, whereby a chamber is formed between each of said plurality of blades, each of said plurality of stationary chamber dividers, said cylindrical rotor, said cylindrical stator, and said pair of end plates, a channel formed in each of said pair of end plates;

an O-ring placed in each of said channels; and a sliding surface placed adjacent each of said O-rings, whereby a seal is formed between each of said pair of end plates and said cylindrical stator and a substantial portion of elements forming the chamber move with the rotor.

8. A rotary engine as in claim 7 further comprising:

an exhaust port on one side of each of said plurality of stationary chamber dividers; and an inlet port on another side of each of said plurality of stationary chamber dividers.

9. A rotary engine as in claim 7 further comprising:

a seal placed between each of said pair of end plates and said cylindrical stator.

10. A rotary engine as in claim 7 wherein:

said sliding surface comprises tetrafluoroethylene.

11. A rotary engine as in claim 7 wherein:

said cylindrical rotor has an axis of rotation, and each of said plurality of movable blades has a longitudinal axis parallel to the axis of rotation of said cylindrical rotor.

12. A rotary engine comprising:

a housing;

a shaft extending though said housing;

a cylindrical rotor placed within said housing and rotating with said shaft;

a pair of end plates attached to said cylindrical rotor, said shaft extending though said end plates;

a plurality of blades held by said cylindrical rotor, each of said plurality of blades adapted to move radially within said cylindrical rotor;

a cylindrical stator attached to said housing and containing said cylindrical rotor and plurality of blades; and a plurality of stationary chamber dividers extending radially from said cylindrical stator and contacting said cylindrical rotor, whereby a chamber is formed between each of said plurality of blades, each of said plurality of stationary chamber dividers, said cylindrical rotor, said cylindrical stator, and said pair of end plates, wherein said cylindrical rotor has an axis of rotation, and each of said plurality of movable blades has a longitudinal axis transverse to the axis of rotation of said cylindrical rotor, whereby a substantial portion of elements forming the chamber move with the rotor.

13. A rotary engine as in claim 12 further comprising:

a spring placed between each of said plurality of blades and said cylindrical rotor, whereby each said plurality of blades is biased radially outward toward said cylindrical stator.

14. A rotary engine comprising:

a housing;

a shaft extending though said housing;

shaft bearings supporting said shaft;

a cylindrical rotor placed within said housing and rotating with said shaft, said cylindrical rotor having a plurality of radial blade channels;

a pair of end plates attached to said rotor, said shaft extending though said end plates, each of said end plates having a circumferential groove;

a plurality of blades, one each of said plurality of blades held within one each of said plurality of blade channels formed within said cylindrical rotor, each of said plurality of blades adapted to move radially within said rotor;

a plurality of springs, one of said plurality of springs placed within one of said plurality of radial blade channels, whereby said plurality of blades are biased outward;

a cylindrical stator attached to said housing and containing said rotor and plurality of blades;

an O-ring placed within the circumferential groove of each of said pair of end plates;

a sliding surface placed adjacent said O-ring and said cylindrical stator, whereby said O-ring slides on said sliding surface and said sliding surface is retained within the circumferential groove; and a plurality of stationary chamber dividers extending radially from said cylindrical stator having a surface adjacent said cylindrical rotor, whereby a chamber is formed between each of said plurality of blades and each of said plurality of stationary chamber dividers;

a seal placed within each of said plurality of stationary chambers dividers contacting said cylindrical stator;

an exhaust port formed within a portion of each of said plurality of stationary chamber dividers on one side of said seal; and an inlet port formed adjacent each of said plurality of stationary chamber dividers on the other side of said seal, whereby a substantial portion of a chamber of the rotary engine rotates with said rotor.

* * * * *